US009359834B2

(12) United States Patent
Jaaskelainen et al.

(10) Patent No.: US 9,359,834 B2
(45) Date of Patent: Jun. 7, 2016

(54) METHOD FOR INSTALLING MULTIPLE SENSORS IN UNROLLED COILED TUBING

(71) Applicant: Halliburton Energy Services, Houston, TX (US)

(72) Inventors: Mikko Jaaskelainen, Katy, TX (US); Kenneth Glenn Dixson, Houston, TX (US); Brian Vandelyn Park, Austin, TX (US); Maximo Gustavo Michaelis, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 355 days.

(21) Appl. No.: 13/771,355

(22) Filed: Feb. 20, 2013

(65) Prior Publication Data

US 2014/0230233 A1 Aug. 21, 2014

(51) Int. Cl.
*H01R 3/00* (2006.01)
*E21B 17/20* (2006.01)

(52) U.S. Cl.
CPC ..... *E21B 17/206* (2013.01); *Y10T 29/49002* (2015.01); *Y10T 29/5313* (2015.01)

(58) Field of Classification Search
CPC .. Y10T 29/49002; H01G 7/023; E21B 47/00; E21B 23/08; E21B 23/14
USPC ..... 29/592.1, 593, 595; 166/250.01, 166/250.02, 383, 385
See application file for complete search history.

(56) References Cited

U.S. PATENT DOCUMENTS

| | | | | |
|---|---|---|---|---|
| 4,948,097 | A * | 8/1990 | Reeve et al. | 254/134.4 |
| 5,211,377 | A * | 5/1993 | Griffioen et al. | 254/134.4 |
| 5,429,194 | A * | 7/1995 | Nice | 166/383 |
| 6,116,085 | A * | 9/2000 | Moffatt et al. | 73/152.46 |
| 6,328,283 | B1 * | 12/2001 | Reeve et al. | 254/134.4 |
| 6,409,155 | B1 * | 6/2002 | Brown et al. | 254/134.4 |
| 6,581,454 | B1 * | 6/2003 | Smith | 73/152.54 |
| 6,675,892 | B2 * | 1/2004 | Kuchuk et al. | 166/250.02 |
| 7,140,435 | B2 * | 11/2006 | Defretin et al. | 166/255.1 |
| 7,747,388 | B2 * | 6/2010 | Mombourquette et al. | 702/11 |
| 7,748,466 | B2 * | 7/2010 | Aivalis et al. | 166/383 |
| 7,845,419 | B2 * | 12/2010 | Naumann | 166/380 |
| 8,074,713 | B2 * | 12/2011 | Ramos et al. | 166/255.1 |
| 8,146,656 | B2 * | 4/2012 | Brown | 166/250.01 |
| 2005/0034857 | A1 * | 2/2005 | Defretin et al. | 166/250.01 |
| 2006/0153508 | A1 * | 7/2006 | Bowker et al. | 385/100 |
| 2010/0096124 | A1 * | 4/2010 | Naumann | 166/250.01 |
| 2011/0073210 | A1 * | 3/2011 | Stretch et al. | 138/177 |
| 2015/0027690 | A1 * | 1/2015 | Aman et al. | 166/250.01 |

FOREIGN PATENT DOCUMENTS

EP 0319194 A1 6/1989

* cited by examiner

*Primary Examiner* — Paul D Kim
(74) *Attorney, Agent, or Firm* — Michael A. Ervin; Krueger Iselin LLP

(57) ABSTRACT

A method for installing multiple fiber optic cables in coiled tubing in oil and gas operations.

14 Claims, 5 Drawing Sheets

METHOD FOR INSTALLING MULTIPLE SENSORS IN UNROLLED COILED TUBING

CROSS-REFERENCE TO RELATED APPLICATIONS

Not applicable.

BACKGROUND

Fiber telemetry in wells is rapidly becoming a standard in the oilfield. One of the techniques for installing fiber sensors in the well is to use coiled tubing. Coiled tubing systems are well known in the oil and gas industry. The term normally connotes a relatively small diameter continuous tubing string that can be transported to a well site on a drum or in a reel. Methods for inserting coiled tubing systems into existing wells are known in the art. As oil and gas exploration technology continues to improve the demand for better wellbore information grows and there has been more interest in using coiled tubing to deploy more instrumentation into the wellbore, particularly pressure and temperature sensors.

Typically a fiber sensor based coiled tubing assembly consists of a number of discrete pressure sensors and FIMTs (Fiber In Metal Tubing), some of which act as temperature sensors themselves using DTS techniques (Distributed Temperature Sensing), or as acoustic sensors using DAS techniques (Distributed Acoustic Sensing) or as conductors of photonic information from the pressure sensors to the surface. As fiber optic telemetry develops there is increased need to install multiple fiber optic sensors inside coiled tubing. Each sensor may require its own FIMT, so there needs to be a method and devices to enable multiple FIMTs to be installed simultaneously in lengths of coiled tubing that can be up to 10 km.

With three pressure sensors and two fibers for DTS, there can be a total of 5 FIMTs that need to be fed into the tubing and come to the surface. A method for pulling the transducers and FIMT assembly into the coiled tubing in an orderly way to prevent sticking or jamming is required, which does not exceed the pulling strain limits of the FIMTs and their connections.

U.S. Pat. No. 6,116,085 to Moffatt describes a manufacturing method for inserting bundles of instrumentation, including thermocouples and pressure sensor wiring, in a coiled tubing system to create a continuous tubing string housing a plurality of pressure sensor assemblies connected to ports along the string and a plurality of thermocouples operative to measure temperatures along the string.

While some of these prior art methods provide workable solutions to the problem of installing sensor assemblies into coiled tubing there is a need for improved production techniques that do not require extensive cutting and welding steps in order to produce the coiled tube sensor assemblies. This need is growing as longer horizontal runs of tubing requiring more strength are being used.

DETAILED DESCRIPTION

In the following detailed description, reference is made that illustrate embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken in a limited sense, and the scope of the disclosure is defined only by the appended claims.

The method to be described herein is an inventive method for installing various and multiple types of sensors into a coiled tubing system to be used down hole in oil and gas operations. Example sensor systems may include multiple fiber optic and/or vibrating wire and/or conventional tubing encapsulated Conductor (TEC) lines and pressure transducers. Other types of sensor commonly found in logging operations including but not limited to Distributed Temperature Sensing (DTS), Distributed Acoustic Sensing (DAS), single point acoustic sensors, resistivity measuring devices, radiation measuring devices, chemical sensors etc. are also possible.

A typical fiber telemetry system inside coiled tubing can consist of three fiber optic pressure transducers, one at the heel, one at the toe and one in the middle of the horizontal portion, along with additional fiber for DTS or DAS telemetry. Each sensor may have single or multiple fibers, which are normally run inside FIMTs. Thus as many as 5 or more FIMTs may have to be installed in the coiled tubing at the same time. Although the number can vary the examples given in this disclosure will demonstrate the deployment of three fiber optic pressure transducers, one at the heel, one at the toe and one in the middle of the horizontal portion, along with additional fiber for DTS or DAS telemetry.

Coiled tubing typically consists of a tube of about 1.5" external diameter made from cold rolled steel, with lengths anything from 500' to 10,000 feet or more. Some versions may have an internal raised seam running the entire length where the weld is made, typically between 1/16" to 1/8" high and wide. This lip is used as a guide for the pressure housing to be described. A slot is cut in the outside of the housing that goes over the lip and prevents the housing from rotating as it is pulled into the tube. On the sides of the housing are grooves that allow FIMTs to pass by the housing from sensors lower down the hole. The grooves enable FIMTs up to 1/4" in diameter to pass. Typically FIMTs range from 1/16" to 1/4" in diameter. The FIMTs are loose in the grooves and not attached to the pressure housing so they impart no loading on the housing.

Figure 1:
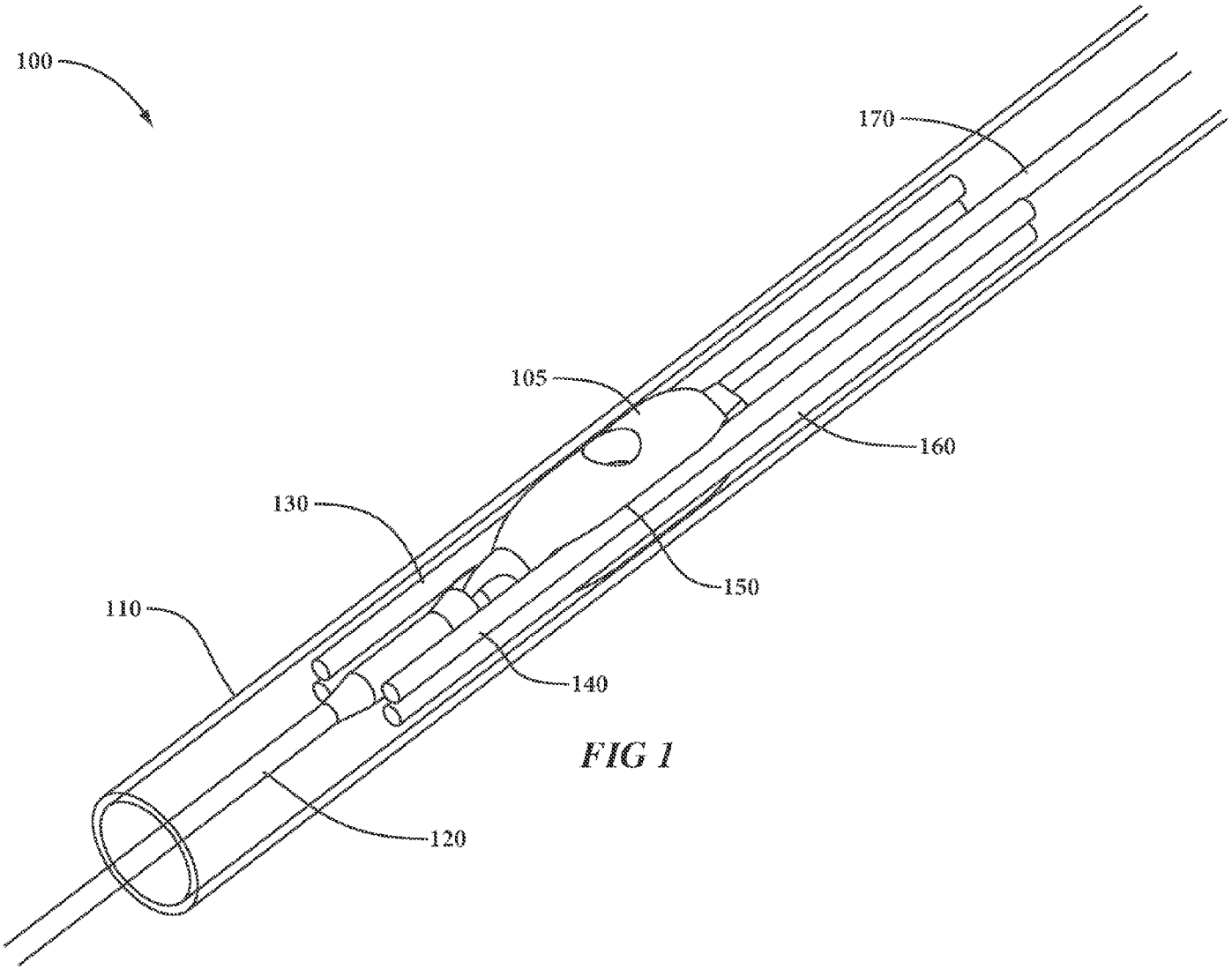
FIG. 1 illustrates a deployment of a pressure housing of one of multiple fiber optic sensors in metal tubing (FIMT's) deployed in coiled tubing.

This is illustrated in FIG. 1, and represented by the numeral 100. A pressure housing 105 is deployed inside coiled tubing 110. Attached to the downhole end of pressure housing 105 is a pull cable 120, with an FiMT 170 attached to the uphole end of the pressure housing. The pull cables are steel or Kevlar cables up to ¼" in diameter. In the instance of three fiber optic pressure transducers, one deployed in the toe, one in the middle, and one at the heel, there will be three pull cables for the pressure sensors. In addition there may be two additional pull cables for the DTS or DAS FIMTs. The pull cables pass through the tubing using vacant grooves 150 in the exterior of the pressure housings (shown in more detail in FIG. 5). Other grooves in the exterior of the pressure housing allow FIMTs to pass through the coiled tubing. Up to five pull cables can be attached, one to each pressure housing and one to each DTS FIMT. If a turn around housing is used for the DTS FIMTs, then one pull cable is attached to the turn around housing and only four pull cables are needed. Thus the complete assembly consists of pressure housings and sensors.

The sensors, comprising e.g., fiber optic, vibrating wire or TEC (Tubing Encapsulated Conductor) cables, chemical sensors, electromagnetic sensors, pressure sensors and pressure block housing can be pulled and/or pumped into the coiled tubing. The sensing string can also include various electrical sensors, including point thermocouples for temperature sensing as well as DTS system calibration. The DTS and or DAS fibers can be deployed inside a FIMT along with the pressure sensors, or pumped into a conduit after installation. The fiber for the DTS can be pumped into a double-ended conduit for some coiled tubing deployments. The location of the pressure transducers, e.g. pressure sensor and pressure block housing are carefully measured before they are pulled into the coiled tubing. The exact location can then be identified using e.g. x-ray systems and/or ultrasonic systems and/or DAS systems by tapping on the coiled tubing and/or by DTS systems and apply a thermal event or other similar methods where distance can be verified and compared with distances measured before the sensing string is pulled into the coiled tubing. Penetrations can then be drilled though the coiled tubing at suitable locations, and suitable seals can be applied to/activated on the assembly. All of the installation of the sensor systems into the tubing is done in the coiled tubing before the coiled tubing is deployed downhole.

In the method of this disclosure FIMTs going to the surface end, and pull cables going to the downhole end. Pressure sensors are typically installed at the toe, center and heel of horizontal wells, so they can be spaced apart by hundreds of feet.

Figure 2:
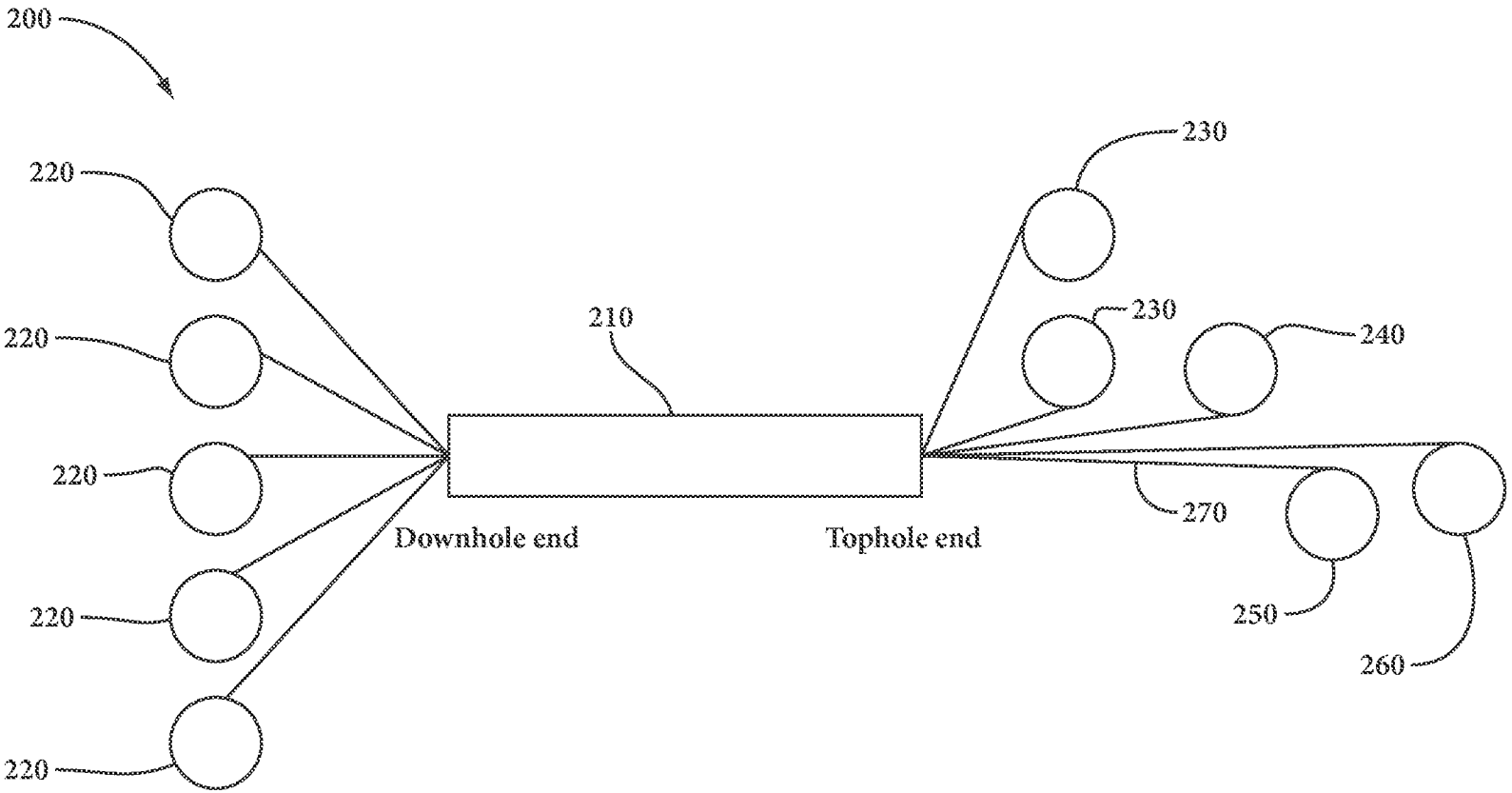
FIG. 2 illustrates a methodology for the installation of multiple fiber optic sensors in metal tubing (FIMT's) deployed in coiled tubing.

To install the assembly in the coiled tubing, the extended coiled tubing is laid out horizontally on the ground. As shown in FIG. 2, represented by the numeral 200, five spools 230, 240, 250, 260 of FIMT 270 are positioned at the tophole end, staggered by the distance their related pressure housings and other sensors will be installed in the tubing. There is also a winch at the surface (tophole) end (not shown) to pull the pull cables to the surface (tophole) end. At the downhole end are five spools 220 of pull cable, each one driven by a winch, either in tandem or individually. To start the process a line is blown through the tubing from the tophole end to the downhole end. The pull cables are attached to the line and pulled through the tube to the surface end using a winch. Each one is run to the FIMT spools, and attached to the pressure housings and DTS or DAS systems.

Figure 3:
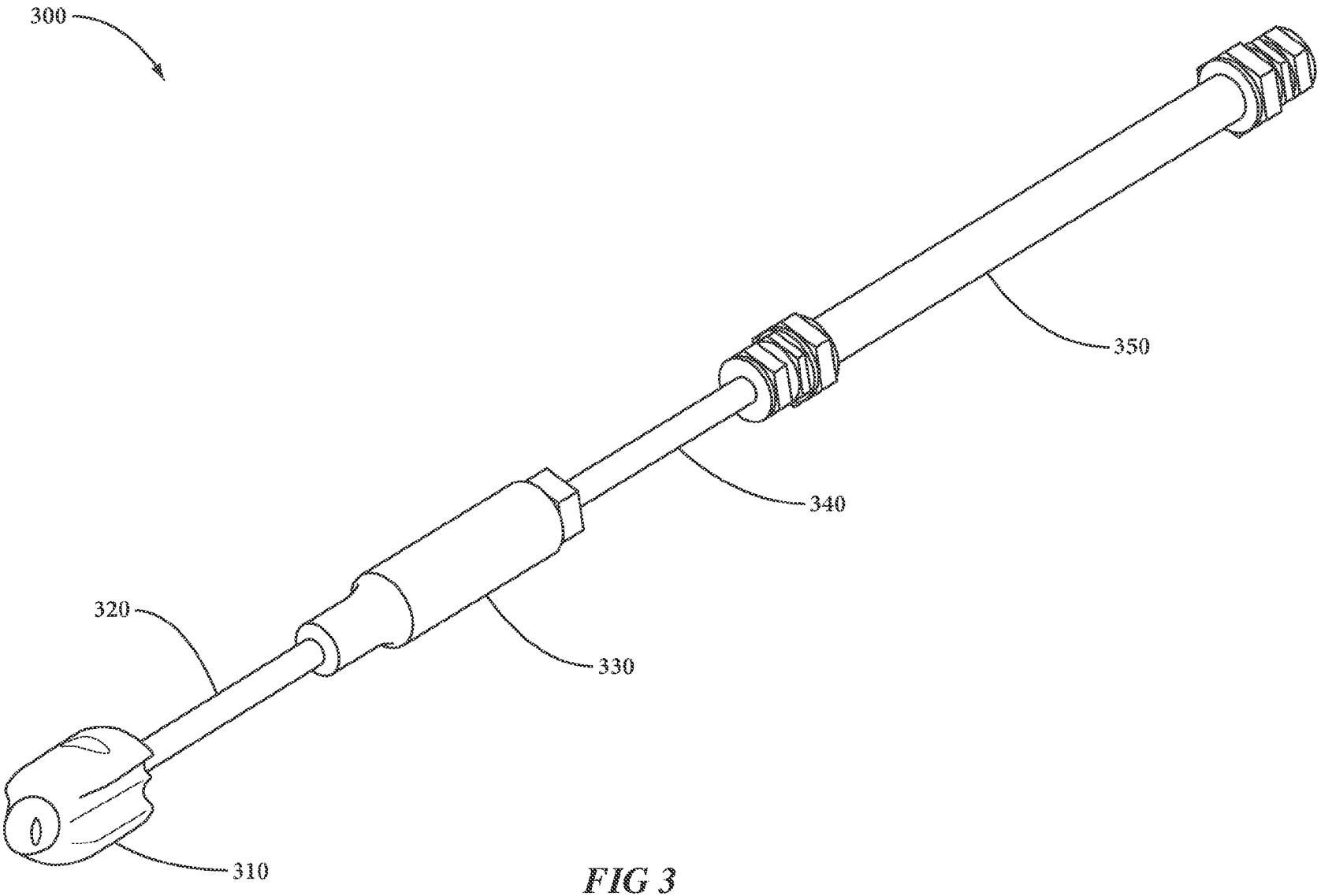
FIG. 3 illustrates a configuration of one of the multiple fiber optic pressure transducers in metal tubing (FIMT's) deployed in coiled tubing.

As shown in FIG. 3, represented generally by the numeral 300, the pressure housing 310, transducer 330, FIMT 340 and splice housing 350 are spliced at the ends of the FIMTs. Now the whole assembly is complete and ready to be pulled into the tubing. The downhole winches of FIG. 2 pull each pull cable into the tubing, with each pull cable taking the tension for each pressure housing. Thus the load is shared between individual pull cables rather than one large pull cable. If one housing is sticking and not the others, tension can be increased to that specific housing to free it, or it's FIMT can be pulled back to loosen it. In addition, water assisted pumping and lubricants sprayed on the FIMTs and pull cables can be used to assist the pull.

As the pressure housings enter the tubing, the FIMTs and pull cables are positioned so that they fit into the grooves in the pressure housing and pass into the tubing.

Figure 4:
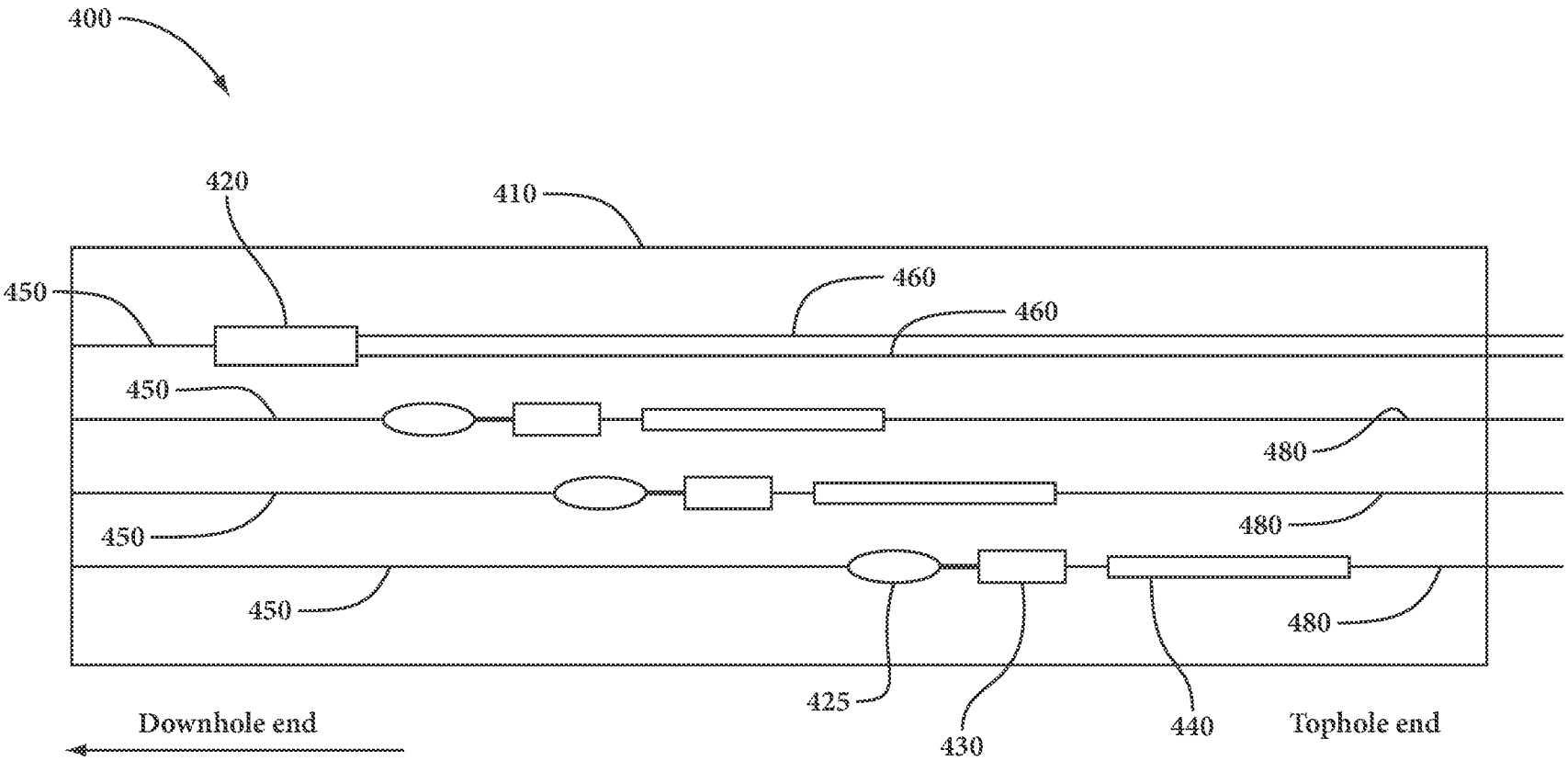
FIG. 4 illustrates a final configuration of multiple fiber optic pressure transducers and a DTS system in metal tubing (FIMT's) deployed in coiled tubing.

A completed installation is shown schematically in FIG. 4, represented by the numeral 400. Within a coiled tube 410 four pull cables 450 are shown connected to three pressure transducer systems and one turnaround housing for a DTS system 420. A pressure housing 425, pressure sensor 430, and splice housing 440 is shown for the heel or tophole end. Once the pull is complete the location of each transducer can be adjusted individually by pulling on each individual pull cable 450 or FIMT 480. The pressure housings can located approximately using a magnetometer, and a magnet inside the housing. Once the housings are positioned, the pull cables are cut at the downhole end and left in the tubing, and the FIMTS are cut to a suitable length at the surface end for installation in the wellhead.

Each of the pressure housings may have a magnet inside the housing to help locate the housing within the tubing by means of a magnetometer or other means like e.g. x-ray. Once the housings are positioned, the pull cables are cut at the downhole end and left in the tubing, and the FIMTS are cut to a suitable length at the surface end for installation in the wellhead. The pressure housings are then permanently fixed in place using techniques such as for example drilling holes through the tubing walls and welding or applying installation screws. Holes are also drilled through the coiled tubing to access pressure ports on each pressure housing.

Once completed ports on the pressure housings are pressure tested via the pressure ports while the entire assembly is still above ground. After successful pressure testing the coiled tubing is rewound on its spool for shipping to the a well site for installation.

Figure 5:
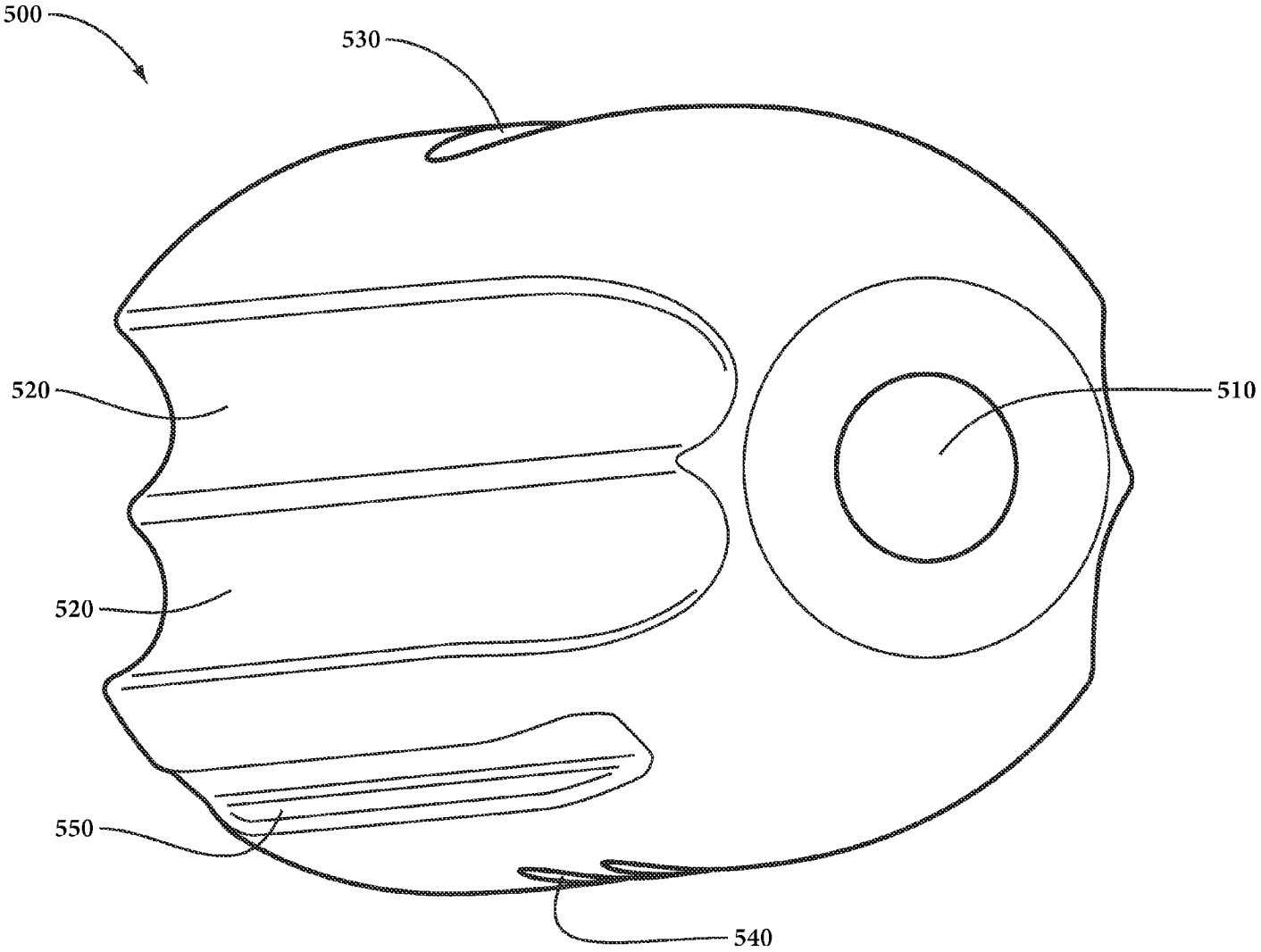
FIG. 5 illustrates an exterior surface for a pressure housing for a pressure sensor installation in coiled tubing

FIG. 5, represented by the numeral 500, illustrates a pressure-housing exterior that makes this possible. A threaded hole 510 on the downhole end accommodates a pull fixture attaching to a pull cable for pulling the pressure housing into the coiled tubing during installation. Grooves 520 along both sides of the pressure-housing exterior are passageways for multiple FIMTs as well as pull cables that can traverse past the pressure block housing without clamping to it. Pinholes 530, 540 on the top and bottom of the housing allow the pin structures to be inserted after drilling of the coiled tubing and a guide slot 550 enables the pressure housing assembly to align correctly along the coiled tubing during installation. Coiled tubing may have an interior weld seam that runs completely through the coiled tube as a result of the manufacture of the tubing. The guide slot 550 rides along that weld seam during the pull through installation of the pressure housings in the coiled tubing.

Although certain embodiments and their advantages have been described herein in detail, it should be understood that various changes, substitutions and alterations could be made without departing from the coverage as defined by the appended claims. Moreover, the potential applications of the disclosed techniques is not intended to be limited to the particular embodiments of the processes, machines, manufactures, means, methods and steps described herein. As a person of ordinary skill in the art will readily appreciate from this disclosure, other processes, machines, manufactures, means, methods, or steps, presently existing or later to be developed that perform substantially the same function or achieve substantially the same result as the corresponding embodiments described herein may be utilized. Accordingly, the appended claims are intended to include within their scope such processes, machines, manufactures, means, methods or steps.

The invention claimed is:

1. A method for installing multiple sensors comprising pressure transducers with pressure block housings, Distributed Temperature Sensing (DTS) sensors, and Distributed Acoustic Sensing (DAS) sensors in unrolled coiled tubing, comprising:

laying the unrolled coiled tubing, having a tophole end and a downhole end, horizontally onto the ground;

after laying, positioning multiple spools of Fiber in Metal Tubing (FIMT) at the tophole end of the coiled tubing, staggered by a distance from the tophole end that each pressure transducer, DTS or DAS sensor will be positioned in the unrolled coiled tubing;

after positioning the multiple spools of FIMT at the tophole end, attaching each of the to be deployed pressure block housings, DTS sensors, and DAS sensors to the end of one of the multiple FIMTs, so that each pressure block housing, DTS Sensor and DAS sensor is attached to one spool of the multiple spools of FIMT;

positioning multiple spools of pull cables, each driven by a separate winch, at the downhole end of the unrolled coiled tubing, with one pull cable spool with one pull cable for each FIMT spool at the top end;

blowing a line through the unrolled coiled tubing from the tophole end to the downhole end;

then attaching each of the pull cables from the multiple spools of pull cables on the downhole end to the line and pulling on the line using a winch at the tophole end to pull the pull cables to the tophole end;

then connecting each pull cable now on the tophole end to one of the pressure block housings, DTS sensors, and DAS sensors so that each pressure block housing, DTS sensor, and DAS sensor is connected to one pull cable spool from the downhole end; and then using the multiple spools of pull cables on the downhole end, each pull cable pulled by a separate winch, to pull the assembled pressure block housings, DTS sensors, and DAS sensors into the unrolled coiled tubing, creating a downhole sensor system in the unrolled coiled tubing;

wherein as each pressure block housing enters the unrolled coiled tubing the FIMTs and pull cables are positioned to fit into grooves in the pressure block housing as they pass into the unrolled coiled tubing.

2. The method for installing multiple sensors comprising pressure transducers with pressure bock housings, DTS sensors, and DAS sensors in unrolled coded tubing of claim 1, further comprising: cutting the pull cables at the downhole end and cutting the FIMTs to a suitable length the uphole end for installation in the wellhead.

3. The method for installing multiple sensors comprising pressure transducers with pressure block housings, DTS sensors, and DAS sensors in unrolled coiled tubing of claim 1, further comprising: locating each of the pressure block housings and drilling through the unrolled coiled tubing to permanently fix the pressure block housings in place.

4. The method for installing multiple sensors comprising pressure transducers with pressure block housings, DTS sensors, and DAS sensors in unrolled coiled tubing of claim 3, wherein permanently fixing the pressure housings in place is accomplished by welding.

5. The method for installing multiple sensors comprising pressure transducers with pressure block housings, DTS sensors, and DAS sensors in unrolled coiled tubing of claim 3, wherein permanently fixing the pressure housings in place is accomplished by installation screws.

6. The method for installing multiple sensors comprising pressure transducers with pressure block housings, DTS sensors, and DAS sensors in unrolled coiled tubing of claim 3 wherein at least one hole is drilled through the unrolled coiled tubing at each pressure block housing location to access pressure ports on each pressure block housing.

7. The method for installing multiple sensors comprising pressure transducers with pressure block housings, DTS sensors, and DAS sensors in unrolled coiled tubing of claim 6 further comprising performing pressure tests on each pressure block housing while the coiled tubing is still on the ground.

8. The method for installing multiple sensors comprising pressure transducers with associated pressure block housings, DTS sensors, and DAS sensors in unrolled coiled tubing of claim 7 further comprising: rewinding the unrolled coiled tubing on a coiled tubing spool for shipping to a well site.

9. The method for installing multiple sensors comprising pressure transducers with pressure block housings, DTS sensors, and DAS sensors in unrolled coiled tubing of claim 1, wherein the installing multiple sensors comprise wherein the other downhole sensor systems comprise fiber optic/vibrating wire sensors.

10. The method for installing multiple sensors comprising pressure transducers with pressure block housings, DTS sensors, and DAS sensors in unrolled coiled tubing of claim 1, wherein the installing multiple sensors comprise wherein the other downhole sensor systems comprise chemical sensors.

11. The method for installing multiple sensors comprising pressure transducers with pressure block housings, DTS sensors, and DAS sensors in unrolled coiled tubing of claim 1, wherein the installing multiple sensors comprise wherein the other downhole sensor systems comprise electromagnetic sensors.

12. The method for installing multiple sensors comprising pressure transducers with pressure block housings, DTS sensors, and DAS sensors in unrolled coiled tubing of claim 1, wherein the installing multiple sensors comprise wherein the other downhole sensor systems comprise tubing encapsulated cable systems.

13. The method for installing multiple sensors comprising pressure transducers with pressure block housings, DTS sensors, and DAS sensors in unrolled coiled tubing of claim 1, wherein the installing multiple sensors comprise wherein the other downhole sensor systems comprise electrical sensors.

14. The method for installing multiple sensors comprising pressure transducers with pressure block housings, DTS sensors, and DAS sensors in unrolled coiled tubing of claim 13, wherein the installing multiple sensors comprise wherein the other electrical sensor systems comprise point thermocouples for temperature sensing or DTS calibration.

* * * * *